US010251807B2

(12) United States Patent
Marson

(10) Patent No.: US 10,251,807 B2
(45) Date of Patent: Apr. 9, 2019

(54) MASSAGE ATTACHMENT DEVICE AND SYSTEM AND METHOD THEREFOR

(71) Applicant: Lou Marson, Scottsdale, AZ (US)

(72) Inventor: Lou Marson, Scottsdale, AZ (US)

( * ) Notice: Subject to any disclaimer, the term of this patent is extended or adjusted under 35 U.S.C. 154(b) by 1118 days.

(21) Appl. No.: 14/570,968

(22) Filed: Dec. 15, 2014

(65) Prior Publication Data

US 2016/0166465 A1 Jun. 16, 2016

(51) Int. Cl.
*A61H 15/00* (2006.01)

(52) U.S. Cl.
CPC ..... *A61H 15/00* (2013.01); *A61H 15/0078* (2013.01); *A61H 2015/0014* (2013.01); *A61H 2201/0119* (2013.01); *A61H 2201/0192* (2013.01); *A61H 2201/164* (2013.01); *A61H 2201/1623* (2013.01); *A61H 2201/1635* (2013.01); *A61H 2201/1685* (2013.01); *A61H 2201/1692* (2013.01); *A61H 2201/1695* (2013.01); *A61H 2205/088* (2013.01)

(58) Field of Classification Search
CPC ..... A61H 15/00; A61H 15/0078; A61H 2201/0123; A61H 2201/0126; A61H 2015/0014
See application file for complete search history.

(56) References Cited

U.S. PATENT DOCUMENTS

| | | | | |
|---|---|---|---|---|
| 2,855,200 | A | 10/1958 | Blickman | |
| 3,707,284 | A | 12/1972 | Waldeck | |
| 5,299,990 | A | 4/1994 | Mehlhoff | |
| 5,569,169 | A | 10/1996 | Leward, Sr. | |
| 6,764,454 | B2 | 7/2004 | Tu | |
| 7,104,939 | B1 | 9/2006 | Martinez | |
| 7,387,599 | B1 | 6/2008 | Hsu | |
| 8,292,837 | B2 | 10/2012 | Du | |
| 8,506,461 | B2 | 8/2013 | Huang et al. | |
| 9,149,410 | B2 * | 10/2015 | Justice Velasco | A61H 15/00 |
| 2004/0024336 | A1 | 2/2004 | Lin | |
| 2012/0028765 | A1 * | 2/2012 | Morin | A61H 15/00 482/91 |
| 2013/0096472 | A1 | 4/2013 | Bertram et al. | |

(Continued)

FOREIGN PATENT DOCUMENTS

| | | |
|---|---|---|
| EP | 2101708 | 9/2009 |

OTHER PUBLICATIONS

Rogue Fitness Pro-Tec Roller Massager http://www.roguefitness.com/pro-tec-roller-massager.

(Continued)

*Primary Examiner* — LaToya M Louis
(74) *Attorney, Agent, or Firm* — Weiss & Moy, P.C.; Jeffrey D. Moy

(57) ABSTRACT

A massage attachment device has a roller bar with a massage sleeve slidably positioned thereon. In one embodiment, the massage attachment device is configured to be removably coupled to a wall mounted rack apparatus. In another embodiment, the massage attachment device is configured to be removably coupled to a portable mounted rack apparatus. A further embodiment of the massage attachment device is configured to be removably coupled to existing squat rack apparatuses. The massage attachment device may be used to massage various muscles, and may be particularly useful following a workout session.

5 Claims, 5 Drawing Sheets

(56) References Cited

U.S. PATENT DOCUMENTS

2015/0231016 A1* 8/2015 Stearns ..... A61H 7/001
601/136
2016/0058656 A1* 3/2016 Harvel ..... A61H 15/0092
601/122

OTHER PUBLICATIONS

RumbleRoller http://www.rumbleroller.com/foam-rollers.html.
Rogue Fitness Monster Single Leg Roller http://www.roguefitness.com/monster-rack-mounted-leg-roller.
Massage Warehouse http://www.massagewarehouse.com/search/?keyword=foot%20roller.

* cited by examiner

MASSAGE ATTACHMENT DEVICE AND SYSTEM AND METHOD THEREFOR

FIELD

This invention relates generally to massage equipment and methods and, more particularly, to a message attachment device and system, wherein the attachment device may be attached to a squat rack apparatus, a portable rack apparatus, or a wall mounted rack apparatus.

BACKGROUND

Squats are a form of exercise routinely performed by body builders and other athletes to strengthen and develop the muscles of the lower and upper body and to increase overall body strength. To facilitate the performance of squats, many types of squat racks (also known as "power racks") have been developed and are known in the art. Existing forms of squat rack apparatuses include varieties that are freestanding, wall mounted, and portable.

After exercising or participating in other types of strenuous activities, a person's muscles may become sore, tight, and fatigued. A massage of the muscles may provide relief to the person's muscles. Further, massaging muscles may help to speed up muscle recovery time. Massaging may help to increase blood flow, alleviate muscle knots, tension, and tightness, and promote muscle rejuvenation. However, visiting a message therapist is time consuming, expensive, inconvenient, and not practical for most people. Although it is possible for individuals to try a manual self-massage, it may be difficult for them to reach and effectively massage each muscle needing attention.

Massage devices have been developed that allow a user to manually self-massage various muscles in the body. However, such massage devices may be bulky, cumbersome, and inconvenient for a user to carry around. Further, such massage devices typically require users to roll the devices over the affected areas of the body, and may present difficulties to the users in effectively reaching and massaging all muscles needing attention. Further, it may be beneficial to raise the muscle that needs to be massaged. However, it may be difficult, for an individual to apply pressure and massage a raised body part.

Therefore, it would be desirable to provide a system and method that overcome the above identified concerns, as well as additional challenges which will become apparent from the disclosure set forth below.

SUMMARY

This summary is provided to introduce a selection of concepts in a simplified form that are further described below in the DESCRIPTION OF THE APPLICATION. This summary is not intended to identify key features of the claimed subject matter, nor is it intended to be used as an aid in determining the scope of the claimed subject matter.

In accordance with an embodiment of the present invention, a massage attachment device is disclosed. The massage attachment devices comprises, in combination: a base member configured to be coupled to a rack apparatus; a roller bar coupled to the base member, wherein the roller bar extends outwardly from a front end of the base member; a massage sleeve configured to be slidably positioned on the roller bar; and a coupling member configured to removably couple the base member to the rack apparatus.

In accordance with another embodiment of the present invention, a wall mounted rack assembly is disclosed. The wall mounted rack assembly comprises, in combination: a wall mounted rack apparatus; wherein the wall mounted rack apparatus comprises: a vertical support member, wherein the vertical support member comprises an elongated and cylindrical body having a top covering, a bottom covering, and a vertical spine, and wherein the vertical spine has a plurality of openings thereon; a vertical back plate coupled to the vertical support member, wherein the vertical back plate comprises an elongated body having a width greater than a width of the vertical support member; wherein the vertical back plate is configured to receive a plurality of fasteners for securing the wall mounted rack apparatus to a wall; and wherein the vertical back plate further comprises a plurality of pegs positioned on a plurality of platforms, and wherein each peg of the plurality of pegs is configured to receive a massage sleeve; and a massage attachment device configured to be removably coupled to the wall mounted rack apparatus; wherein the massage attachment device comprises: a base member configured to be coupled to the wall mounted rack apparatus; a roller bar coupled to the base member, wherein the roller bar extends outwardly from a front end of the base member; a massage sleeve configured to be slidably positioned on the roller bar; and a coupling member configured to removably couple the base member to the wall mounted rack apparatus.

In accordance with a further embodiment of the present invention, a portable rack assembly is disclosed. The portable rack assembly comprises, in combination: a portable mounted rack apparatus; wherein the portable mounted rack apparatus comprises: a vertical support member, wherein the vertical support member comprises an elongated and cylindrical body having a top covering, a vertical spine, and a base plate, and wherein the vertical spine has a plurality of openings thereon; a rear support bracket coupled to the vertical support member, wherein the rear support bracket comprises a front wall, a pair of spaced-apart lateral sidewalls, and a base floor defined between the sidewalls; and a base; and a massage attachment device configured to be removably coupled to the portable mounted rack apparatus; wherein the massage attachment device comprises: a base member configured to be coupled to the portable mounted rack apparatus; a roller bar coupled to the base member, wherein the roller bar extends outwardly from a front end of the base member; a massage sleeve configured to be slidably positioned on the roller bar; and a coupling member configured to removably couple the base member to the portable mounted rack apparatus.

BRIEF DESCRIPTION OF THE DRAWINGS

Embodiments of the disclosure will become more fully understood from the detailed description and the accompanying drawings, wherein.

Common reference numerals are used throughout the drawings and detailed description to indicate like elements.

DETAILED DESCRIPTION

Figure 1A:
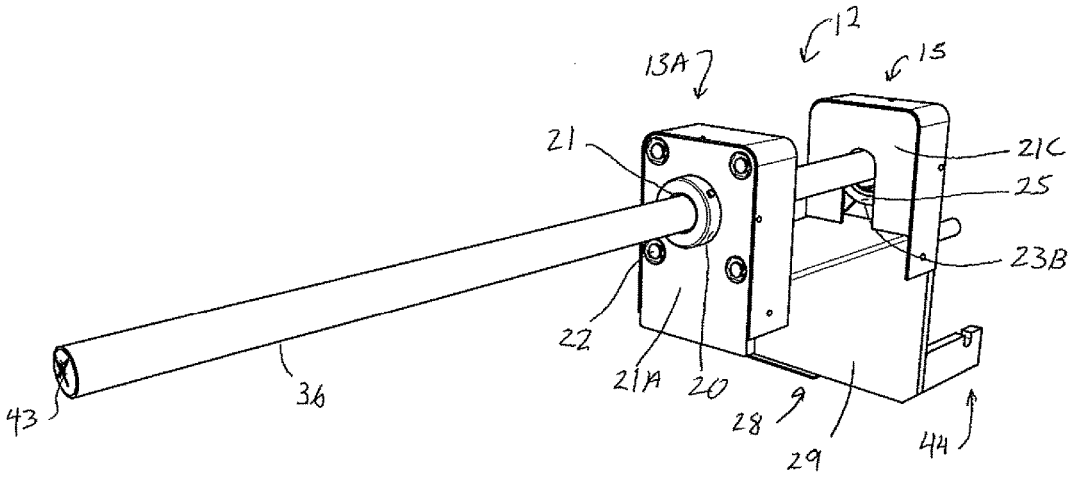
FIG. 1A is a front perspective view of a massage attachment device, in accordance with an embodiment of the present invention with a massage sleeve and massage ball removed.
Figure 1B:
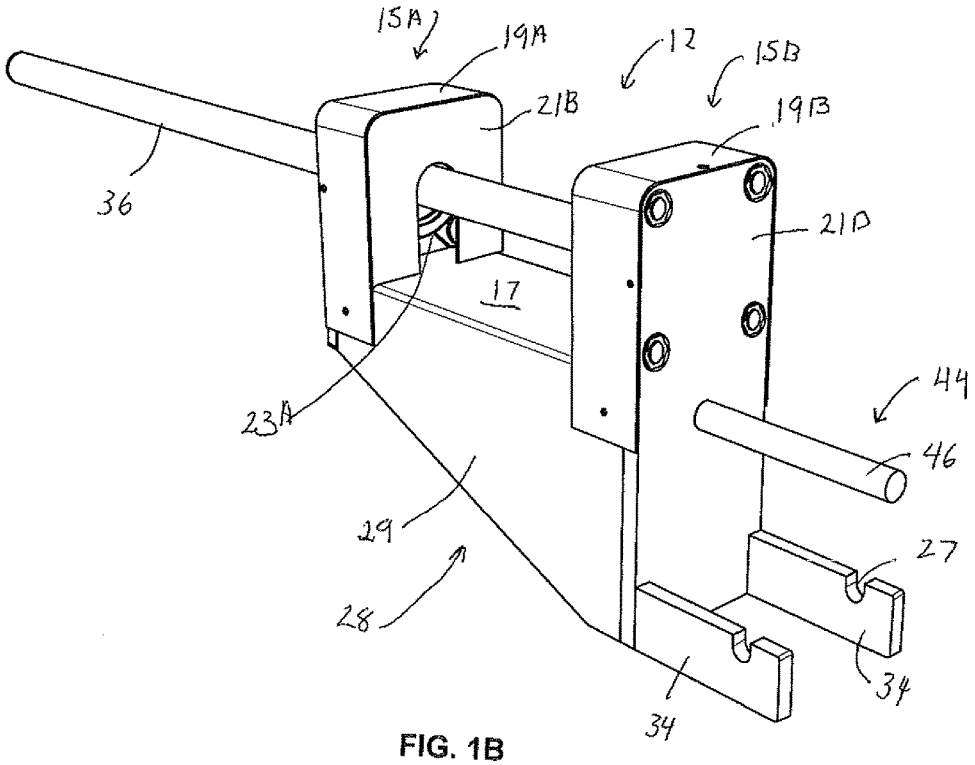
FIG. 1B is a back perspective view of the massage attachment device of FIG. 1A.
Figure 1C:
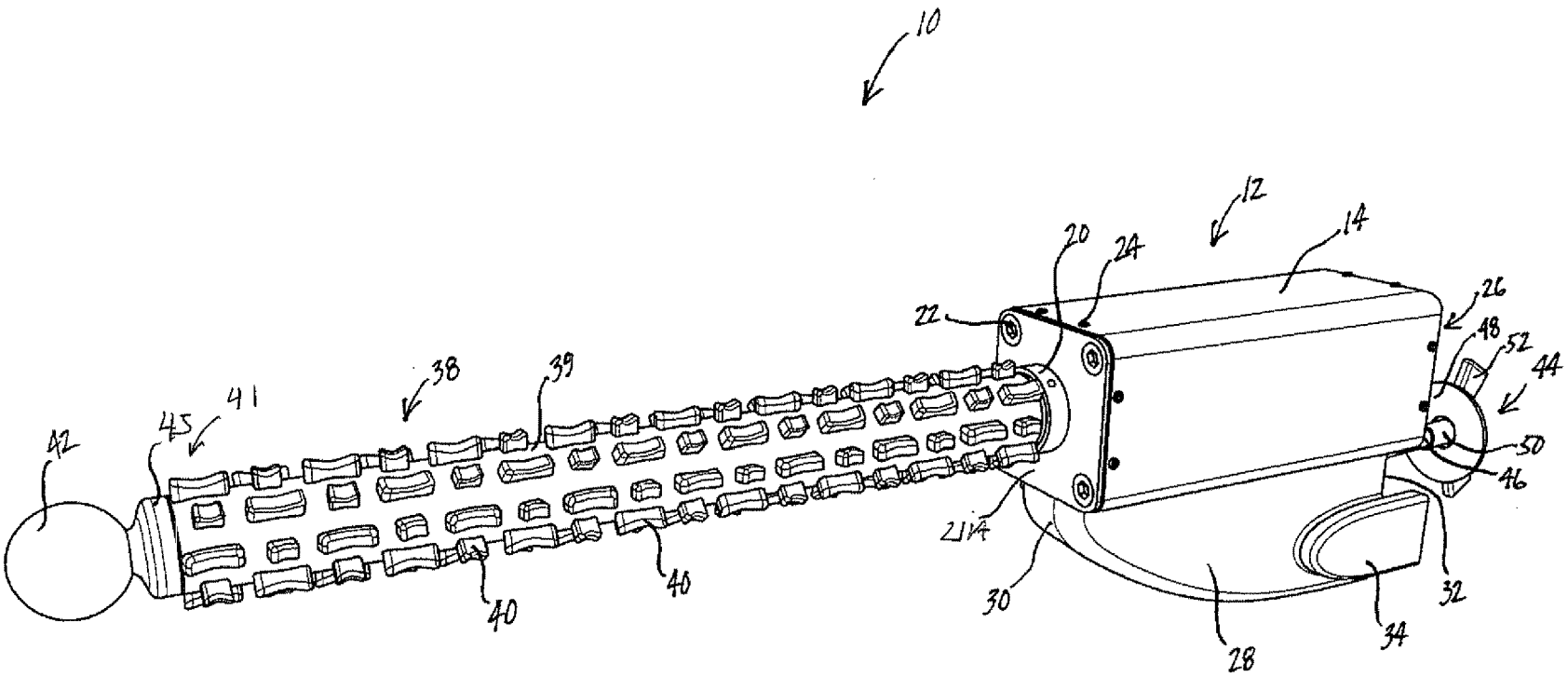
FIG. 1C is a perspective view of a massage attachment device of FIGS. 1A and 1B with the massage sleeve, massage ball and a cover coupled thereto.

Referring to FIGS. 1A-1C, an embodiment of a massage attachment device 10, in accordance with an embodiment of the present invention may be shown. The massage attachment device 10 may be configured to be removably coupled to an exercise rack apparatus, such as a free standing rack apparatus, wall mounted rack apparatus or a portable mounted rack apparatus (hereinafter rack apparatus), as further described herein. When coupled to a rack apparatus, the massage attachment device 10 may be used by a user to massage various muscles of the body, such as those in the legs, hips, arms, shoulders, and back. The massage attachment device 10 may be particularly useful for massaging muscles after a workout in order to help to speed up muscle recovery time. Use of the massage attachment device 10 may also help to increase blood flow, alleviate muscle knots, tension, and tightness, and promote muscle rejuvenation.

FIGS. 1A-1C may show one side of the massage attachment device 10, but it should be understood that the opposing side of the massage attachment device 10 may be a mirror image thereof. The massage attachment device 10 generally comprises the following principal components: a base member 12, a roller bar 36, a massage sleeve 38, a massage ball 42, and a coupling member 44.

Referring first to the base member 12, the base member 12 may be comprised of a pair of spaced-apart upright vertical support members, including a front vertical support member 15A and a back vertical support member 15B, and a lower base portion 17.

Referring to the front vertical support member 15A, the front vertical support member 15A comprises a generally U-shaped frame 19A, to which a front plate 21A and a back plate 21B may be coupled. The front plate 21A may be coupled to a front portion of the U-shaped frame 19A. The front plate 21A may include a plurality of fasteners 22, such as nuts and bolts, screws, or some other suitable type of fasteners, may be inserted for coupling the front plate 21A to the U-shape frame 19A. In this embodiment, four fasteners 22 may be employed. However, it may be desired to employ more than four or less than four fasteners 22, without departing from the spirit and scope of the invention.

The front plate 21A may include a central, front opening 21. The front opening 21 may be circular in shape. A support ring 20 may be coupled to the front plate 21A. The support ring 20 may surround the front opening 21. The support ring 20 may be a ball bearing washer ring or similar device. The support ring 20 may allow for a smoother rotation of the roller bar 36 when the roller bar 36 is positioned through the support ring 20.

The back plate 21B may be coupled to a back portion of the U-shape frame 19A. The back plate 21B may comprise a generally inverted U-shape plate having a U-shaped opening 23. The front opening 21, support ring 20, and U-shaped opening 23A may each be configured to receive a portion of the roller bar 36, which may pass there through.

Referring to the back vertical support member 15B, the back vertical support member may comprises a generally U-shaped frame 19B, to which may be coupled a front plate 21C and a back plate 21D. The front plate 21C may be coupled to a front portion of the U-shape frame 19B. The front plate 21C may comprise a generally inverted U-shape plate defining a U-shaped opening 23B. The back plate 21D is coupled to a back portion of the U-shaped frame 19B. The back plate 21D may include a plurality of fasteners 22, such as nuts and bolts, screws, or some other suitable type of fasteners, for coupling the back plate 21D to the U-shaped frame 19B. In this embodiment, four fasteners 22 may be employed. However, it may be desired to employ more than four or less than four fasteners 22, without departing from the spirit and scope of the invention. Interposed between the front plate 21C and back plate 21D is a support ring 25. The support ring 25 may be a ball bearing washer ring or similar device. The support ring 25 may allow for a smoother rotation of the roller bar 36 when the roller bar 36 is positioned through the support ring 25. The opening 23B and support ring 25 are each configured to receive a portion of the roller bar 36, which may pass there through and, in turn, abut an interior surface of the back plate 21D. A cover 14 may be positioned over the base 12

The back plate 21D may include a coupling member 44 and a pair of spaced-apart support arms 34 coupled thereto. The coupling member 44 may be an elongated pin 46 that may extend outwardly from the back plate 21D. The pin 46 may include exterior threading. A connector member 50 may be configured to be removably coupled to the pin 46. The connector member 50 may include interior threading configured to communicate with the exterior threading of the pin 46 thereby enabling the massage attachment device 10 to be secured in place on one of the above disclosed rack apparatus, as further described herein. The connector member 50 may have one or more handles 52 to allow one to more easily grip the connector member 50.

The spaced-apart support arms 34 may each include a notch 27. Utilizing the coupling member 44 and spaced-apart support arms 34, the massage attachment device 10 may be removably coupled to a rack apparatus, such as existing squat rack apparatuses, as described further herein.

In order to attach the massage attachment device 10 to a rack apparatus, such as a squat rack apparatus (not shown), the user may pin 46 through an opening on a vertical support member of the squat rack apparatus (not shown). A user would select an opening on a vertical support member of the squat rack apparatus corresponding to an appropriate height desired by the user for utilizing the massage attachment device 10. With the pin 46 in position in an opening on the squat rack apparatus, the connector member 50 may be attached to the pin 46 to lock the pin 46 in the opening. With the pin 46 in the opening, the support arms 34 may each abut a side of the vertical support member of the squat rack apparatus. The support arms 34 may extend beyond the vertical support member of the squat rack apparatus. A user could then insert a pin (not shown) through the notches 27 on the support arms 34. In this way, the support arms 34 and pin will help to stabilize the massage attachment device 10 and thereby prevent the massage attachment device 10 from becoming disengaged from the squat rack apparatus. Once the massage attachment device 10 is in position on the squat rack apparatus, a user may proceed to utilize the massage attachment device 10 to massage various muscles.

Referring to a lower base portion 28, the lower base portion 28 may include a pair of side plates 29. An upper portion of each of the side plates 29 abuts the lower base 17. The side plates 29 may be generally downwardly sloped at a bottom portion thereof from front to back, such that a rear portion of the lower base portion 29 is greater in depth than a front portion of the lower base portion 29. The lower base portion provides stability and support when the massage attachment device 10 may be removably coupled to a rack apparatus.

Turning now to the roller bar 36, the roller bar 36 may comprise a substantially elongated, cylindrically shaped member. The roller bar 36 may be rotationally coupled to the back plate 21D. A proximate front end 36A of the roller bar extends outwardly through the U-shape opening 23B, the U-shape opening 23A, the central opening 21 and support ring 20. The roller bar 36 may be configured to rotate freely as a user moves across the roller bar 36. Alternatively, the roller bar 36 may be coupled to a motorized device to rotate the roller bar 36.

The roller bar 36 is configured to receive the massage sleeve 38. With respect to the massage sleeve 38, the massage sleeve 38 generally comprises a substantially elongated, tubular member including an outer surface 39. In this embodiment, the massage sleeve 38 includes a plurality of massage nodules 40 positioned on the outer surface 39 of the massage sleeve 38. The massage nodules 40 may be configured in various shapes and sizes, as desired. The massage sleeve 38 is complementary in size to the roller bar 36 and is configured to be slidably positioned onto the roller bar 36.

In accordance with one embodiment, a locking mechanism 41 may be used to secure the massage sleeve 38 to the roller bar 36. In accordance with one embodiment, a locking slot and tab may be used. In the locking slot and tab, the distal end of the roller bar 36 may have a tab member 43 formed thereon. The tab member 43 may correspond to a slot formed in an end cap 45 of the massage sleeve 38. By rotating the tab member 43 within the slot in the end cap 45, the massage sleeve 38 may be secured to the roller bar 36. Other locking mechanisms 41 may be used such as locking screws and the like may be used without departing from the spirit and scope of the present invention.

A massage ball 42 may be connected to the roller bar 36. The massage ball 42 may be connected to roller bar 36 in different manners. In accordance with one embodiment, a locking screw may be used to secure the massage ball 42 may be connected to the roller bar 36. Alternatively, the massage ball 42 may have a threaded stem extending there from. The threaded stem may be coupled to a corresponding threaded channel formed in the distal end of the roller bar 36.

Figure 3:
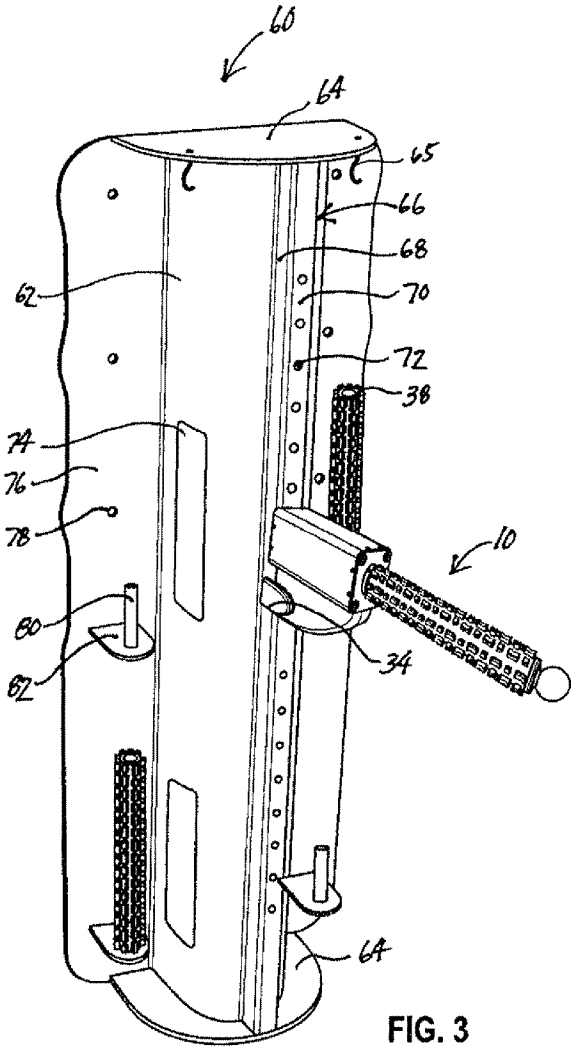
FIG. 3 is another perspective view of the wall mounted rack apparatus of FIG. 2A, showing the massage attachment device of FIG. 1C and a plurality of massage sleeves in position thereon, in accordance with an embodiment of the present application.
Figure 2B:
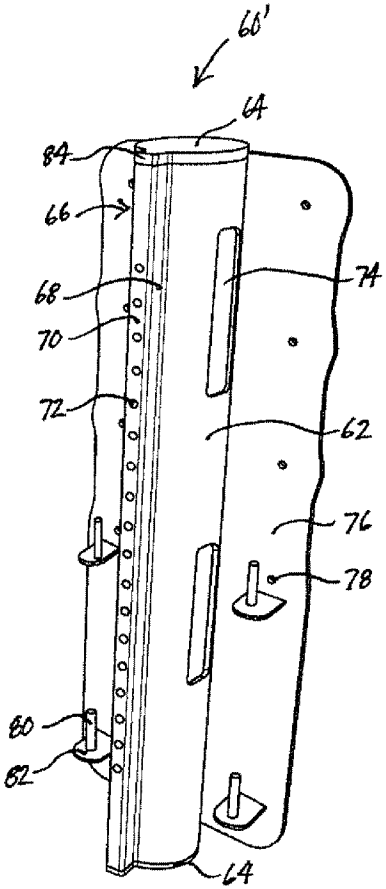
FIG. 2B is a perspective view of a wall mounted rack apparatus, in accordance with an embodiment of the present application.
Figure 2A:
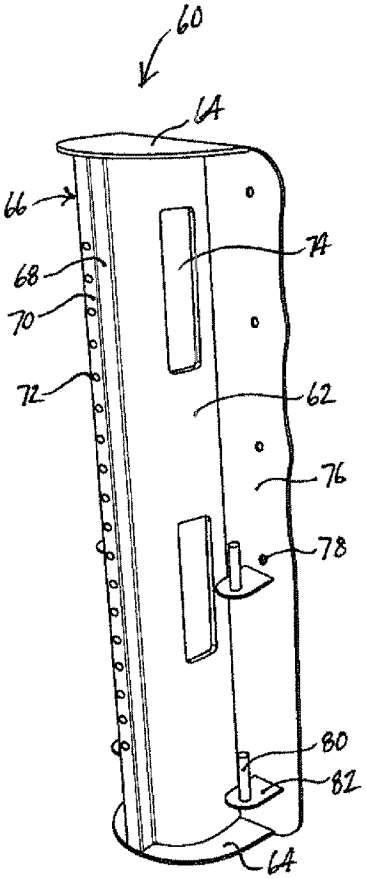
FIG. 2A is a perspective view of a wall mounted rack apparatus, in accordance with an embodiment of the present application.

Referring now to FIGS. 2A and 3, an embodiment of a wall mounted rack apparatus 60, in accordance with an embodiment of the present invention is shown. The wall mounted rack apparatus 60 is configured to receive the massage attachment device 10, which may be removably coupled to the wall mounted rack apparatus 60. When coupled to the wall mounted rack apparatus 60, the massage attachment device 10 may be used by a user to massage various muscles of the body, such as those in the legs, hips, arms, shoulders, and back.

The wall mounted rack apparatus 60 generally comprises the following principal components: a vertical support member 62 and a vertical back plate 76 coupled to the support member 62. Referring to the support member 62, the support member 62 comprises a substantially elongated and cylindrical hollow body. The support member 62 includes top and bottom coverings 64. In this embodiment, the coverings 64 are each substantially semi-circular in shape, having a squared-off rear edge that abuts the back plate 76. The top covering 64 may include one or more hooks 65. The support member 62 further includes a vertical spine 66. In this embodiment, the spine 66 is substantially elongated and is complementary in length to the length of the support member 62. The spine 66 is interposed between the top and bottom coverings 64. The spine 66 may be three-sided, having two side surfaces 68 and a front surface 70. The front surface 70 of the spine 66 includes a plurality of openings 72. The openings 72 are each configured to receive the pin 46 of the coupling member 44 of the massage attachment device 10, shown in FIG. 1, as described further herein. The support member 62 further includes a plurality of spaced-apart side openings 74. In this embodiment, four side openings 74 are employed, with opposing sides of the vertical support member 62 each having two side openings 74 positioned thereon, as can be seen from FIGS. 2 and 3. However, it would be possible to configure the support member 62 with more than four or less than four side openings 74, without departing from the spirit and scope of the invention. In this embodiment, the side openings 74 are substantially rectangular in shape, but may be shaped in other ways, as desired, without departing from the spirit and scope of the invention. The side openings 74 are configured to permit a user to reach the user's hand into the side openings 74 in order to affix the massage attachment device 10 onto the wall mounted rack apparatus 60, as further described herein. Each of the side openings 74 aligns with a plurality of the front openings 72 on the spine 66. The side openings 74 may be alternately positioned on the support member 62, such that a first side opening 74 is positioned higher in relation to a second side opening 74, a second side opening 74 is positioned higher in relation to a third side opening 74, and a third side opening 74 is positioned higher in relation to a fourth side opening 74. Thus, each of the plurality of front openings 72 on the spine 66 aligns with at least one side opening 74. In this way, a user is able to select an appropriate side opening 74 corresponding to a desired front opening 72 where the user may desire to affix the massage attachment device 10 onto the wall mounted rack apparatus 60.

Referring to the back plate 76, the back plate 76 comprises a substantially elongated body that is complementary in length to the length of the support member 62. In this embodiment, the back plate 76 is greater in width than the support member 62. The back plate 76 includes a plurality of openings through which fasteners 78, such as screws or some other suitable type of fasteners, may be inserted in order to secure the wall mounted rack apparatus 60 onto a wall. In this embodiment, six fasteners 78 are employed. However, it would be possible to configure the back plate 76 to utilize more than six or less than six fasteners, without departing from the spirit and scope of the invention. The back plate 76 may further include a plurality of pegs 80 positioned on a plurality of platforms 82. The pegs 80 are each configured to receive and hold a massage sleeve 38 to allow for storage of one or more massage sleeves 38 when not in use, as may be seen in FIG. 3.

Referring now to FIG. 2B, another embodiment of a wall mounted rack apparatus 60, hereinafter wall mounted rack apparatus 60', in accordance with an embodiment of the present invention is shown. The wall mounted rack apparatus 60' is similar to the wall mounted rack apparatus 60, except that the top and bottom coverings 64 are substantially circular in shape. Overall, the wall mounted rack apparatus 60' provides the same features and benefits as the wall mounted rack apparatus 60. The wall mounted rack apparatus 60' is configured to receive the massage attachment device 10, which may be removably coupled to the wall mounted rack apparatus 60'. When coupled to the wall mounted rack apparatus 60', the massage attachment device 10 may be used by a user to massage various muscles of the body, such as those in the legs, hips, arms, shoulders, and back.

The wall mounted rack apparatus 60' generally comprises the following principal components: a vertical support member 62 and a vertical back plate 76 coupled to the support member 62. Referring to the support member 62, the support member 62 comprises a substantially elongated and cylindrical hollow body. The support member 62 includes top and bottom coverings 64'. In this embodiment, the coverings 64' are each substantially circular in shape, having a front portion 84 that aligns with a vertical spine 66 of the support member 62. In this embodiment, the spine 66 is substantially elongated and is complementary in length to the length of the support member 62. The spine 66 is interposed between the top and bottom coverings 64'. The spine 66 may be three-sided, having two side surfaces 68 and a front surface 70. The front surface 70 of the spine 66 includes a plurality of openings 72. The openings 72 are each configured to receive the pin 46 of the coupling member 44 of the massage attachment device 10, shown in FIG. 1, as described further herein. The support member 62 further includes a plurality of spaced-apart side openings 74. In this embodiment, four side openings 74 are employed, with opposing sides of the vertical support member 62 each having two side openings 74 positioned thereon. However, it would be possible to configure the support member 62 with more than four or less than four side openings 74, without departing from the spirit and scope of the invention. In this embodiment, the side openings 74 are substantially rectangular in shape, but may be shaped in other ways, as desired, without departing from the spirit and scope of the invention. The side openings 74 are configured to permit a user to reach the user's hand into the side openings 74 in order to affix the massage attachment device 10 onto the wall mounted rack apparatus 60', as further described herein. Each of the side openings 74 aligns with a plurality of the front openings 72 on the spine 66. The side openings 74 may be alternately positioned on the support member 62, such that a first side opening 74 is positioned higher in relation to a second side opening 74, a second side opening 74 is positioned higher in relation to a third side opening 74, and a third side opening 74 is positioned higher in relation to a fourth side opening 74. Thus, each of the plurality of front openings 72 on the spine 66 aligns with at least one side opening 74. In this way, a user is able to select an appropriate side opening 74 corresponding to a desired front opening 72 where the user may desire to affix the massage attachment device 10 onto the wall mounted rack apparatus 60'.

Referring to the back plate 76, the back plate 76 comprises a substantially elongated body that is complementary in length to the length of the support member 62. In this embodiment, the back plate 76 is greater in width than the support member 62. The back plate 76 includes a plurality of openings through which fasteners 78, such as screws or some other suitable type of fasteners, may be inserted in order to secure the wall mounted rack apparatus 60' onto a wall. In this embodiment, six fasteners 78 are employed. However, it would be possible to configure the back plate 76 to utilize more than six or less than six fasteners, without departing from the spirit and scope of the invention. The back plate 76 may further include a plurality of pegs 80 positioned on a plurality of platforms 82. The pegs 80 are each configured to receive and hold a massage sleeve 38 to allow for storage of one or more massage sleeves 38 when not in use, as may be seen in FIG. 3.

In order to utilize the massage attachment device 10 with the wall mounted rack apparatus 60 or 60', a user would first couple the massage attachment device 10 to the wall mounted rack apparatus 60 or 60' by inserting the pin 46 of the coupling member 44 through one of the openings 72 in the spine 66 of the support member 62. A user would select an opening 72 corresponding to an appropriate height desired by the user for utilizing the massage attachment device 10. A user would then reach through one of the side openings 74 adjacent to the selected opening 72 and engage the back plate 48 of the coupling member 44 onto the pin 46 to secure the massage attachment device 10 in place on the wall mounted rack apparatus 60 or 60'. When the massage attachment device 10 is in position on the wall mounted rack apparatus 60 or 60', each of the stop arms 34 of the massage attachment device 10 should abut a corresponding side surface 68 of the spine 66. In this way, the stop arms 34 will help to prevent the massage attachment device 10 from shifting from side to side when in position on the wall mounted rack apparatus 60 or 60'. Once the massage attachment device 10 is in position on the wall mounted rack apparatus 60 or 60', a user may proceed to utilize the massage attachment device 10 to massage various muscles.

Figure 4:
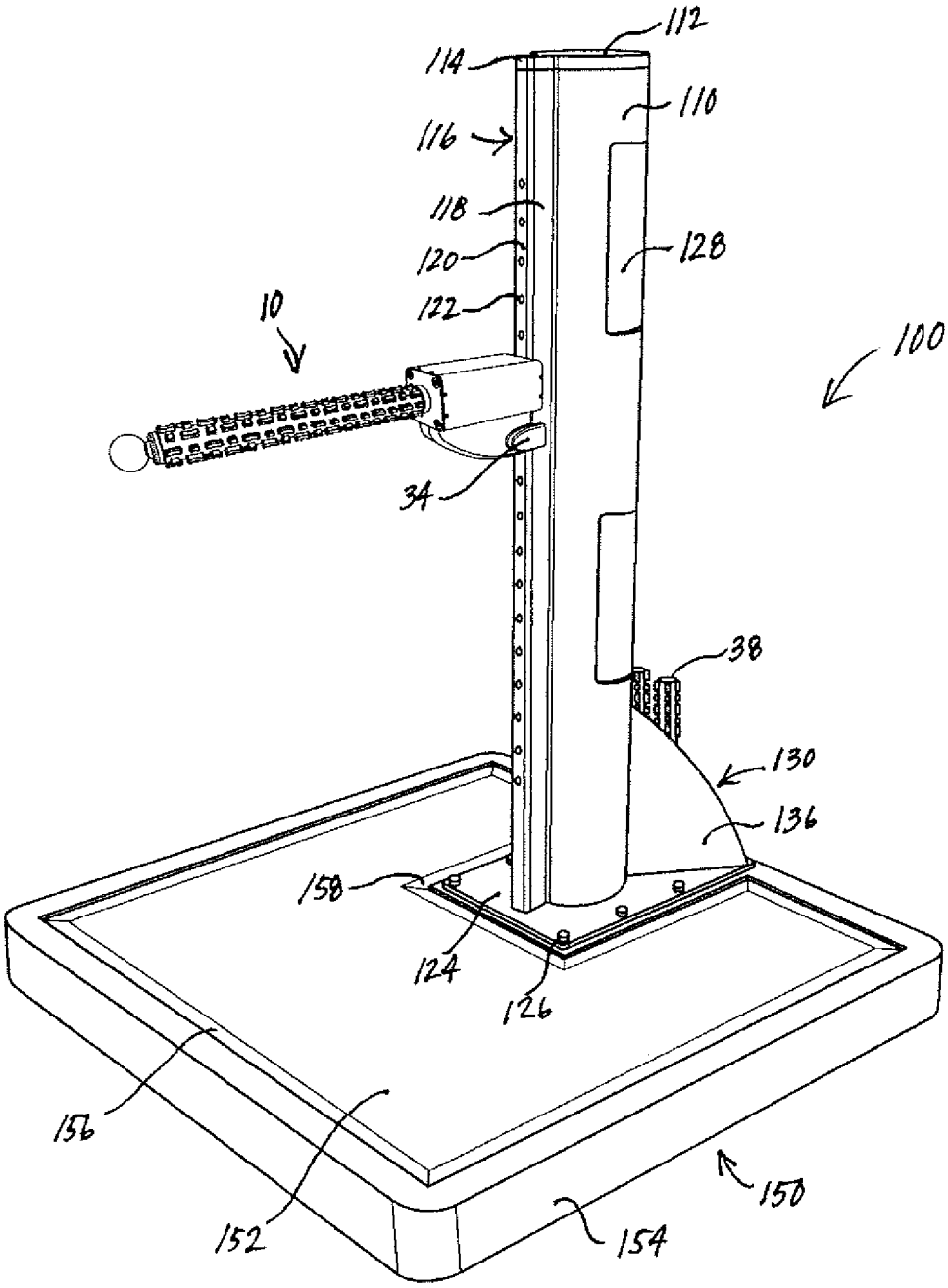
FIG. 4 is a front perspective view of a portable mounted rack apparatus, showing the massage attachment device of FIG. 1C and a plurality of massage sleeves in position thereon, in accordance with an embodiment of the present application.
Figure 5:
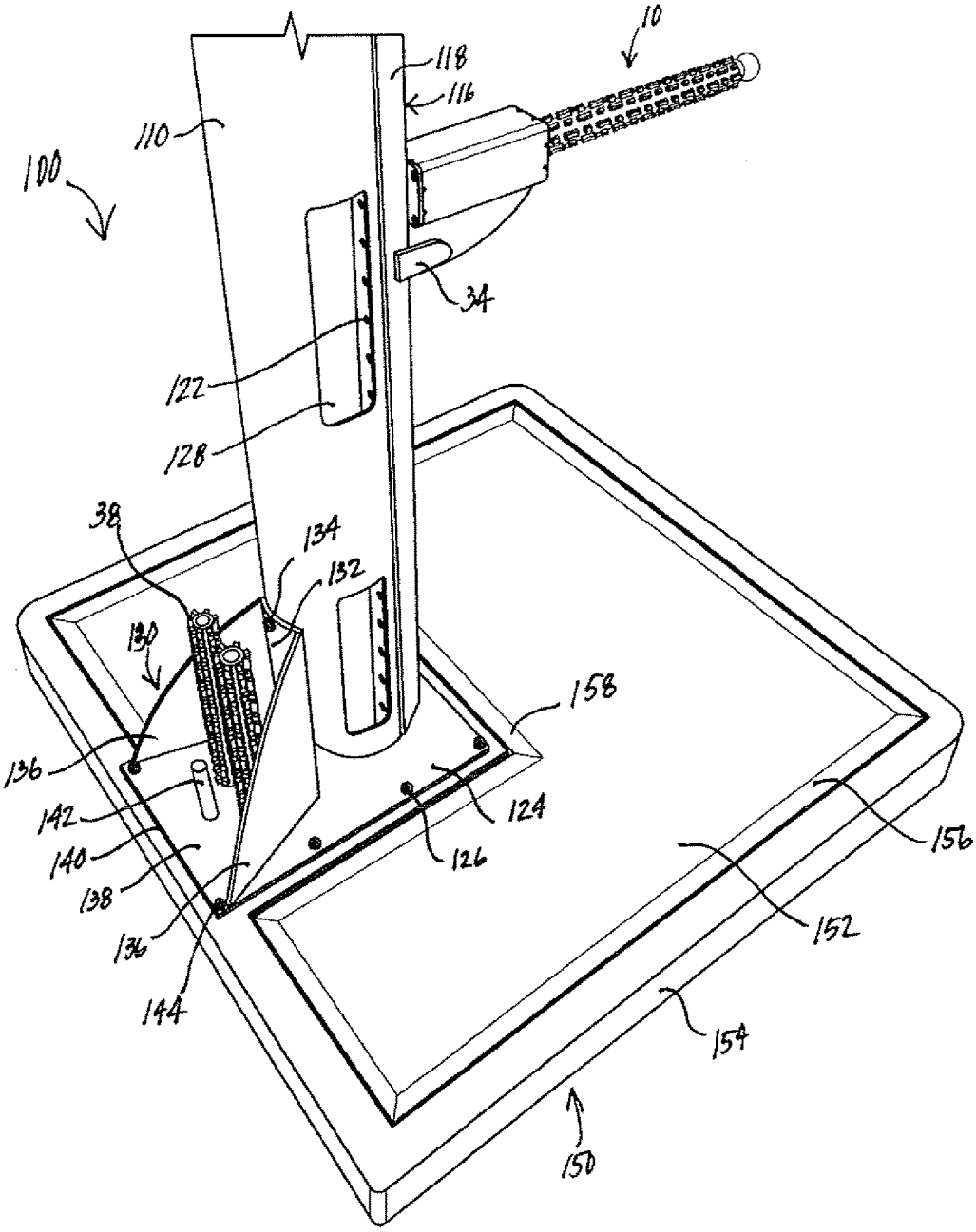
FIG. 5 is a back perspective view of a portion of the portable mounted rack apparatus of FIG. 4, showing the massage attachment device of FIG. 1C and a plurality of massage sleeves in position thereon.

Referring now to FIGS. 4-5, an embodiment of a portable mounted rack apparatus 100, in accordance with an embodiment of the present invention is shown. The portable mounted rack apparatus 100 is configured to receive the massage attachment device 10, which may be removably coupled to the portable mounted rack apparatus 100. When coupled to the portable mounted rack apparatus 100, the massage attachment device 10 may be used by a user to massage various muscles of the body, such as those in the legs, hips, arms, shoulders, and back.

The portable mounted rack apparatus 100 generally comprises the following principal components: a vertical support member 110, a rear support bracket 130 and a base 150. Referring to the support member 110, the support member 110 comprises a substantially elongated and cylindrical hollow body. The support member 110 includes a top covering 112. In this embodiment, the covering 112 is substantially circular in shape, having a front portion 114 that aligns with a vertical spine 116 of the support member 110. In this embodiment, the spine 116 is substantially elongated and is complementary in length to the length of the support member 110. The spine 116 is interposed between the covering 112 and a base plate 124 of the support member 110. The spine 116 may be three-sided, having two side surfaces 118 and a front surface 120. The front surface 120 of the spine 116 includes a plurality of openings 122. The openings 122 are each configured to receive the pin 46 of the coupling member 44 of the massage attachment device 10, shown in FIG. 1, as described further herein. The base plate 124 of the support member 110 comprises a substantially rectangular platform. The base plate 124 may include a plurality of openings into which a plurality of fasteners 126, such as screws or some other suitable type of fasteners, may be inserted in order to couple the support member 110 to the base 150 of portable mounted rack apparatus 100. The support member 110 further includes a plurality of spaced-apart side openings 128. In this embodiment, four side openings 128 are employed, with opposing sides of the vertical support member 110 each having two side openings 128 positioned thereon, as can be seen from FIGS. 4 and 5. However, it would be possible to configure the support member 110 with more than four or less than four side openings 128, without departing from the spirit and scope of the invention. In this embodiment, the side openings 128 are substantially rectangular in shape, but may be shaped in other ways, as desired, without departing from the spirit and scope of the invention. The side openings 128 are configured to permit a user to reach the user's hand into the side openings 128 in order to affix the massage attachment device 10 onto the portable mounted rack apparatus 100, as further described herein. Each of the side openings 128 aligns with a plurality of the front openings 122 on the spine 116. The side openings 128 may be alternately positioned on the support member 110, such that a first side opening 128 is positioned higher in relation to a second side opening 128, a second side opening 128 is positioned higher in relation to a third side opening 128, and a third side opening 128 is positioned higher in relation to a fourth side opening 128. Thus, each of the plurality of front openings 122 on the spine 116 aligns with at least one side opening 128. In this way, a user is able to select an appropriate side opening 128 corresponding to a desired front opening 122 where the user may desire to affix the massage attachment device 10 onto the portable mounted rack apparatus 100.

Referring to the rear support bracket 130, the rear support bracket 130 provides stability for the support member 110 and may also provide a storage area for one or more massage sleeves 38 when not in use. Referring to FIG. 5, the rear support bracket 130 generally comprises a front wall 132, a pair of spaced-apart lateral sidewalls 136, and a base floor 138 defined between the sidewalls 136. The sidewalls 136 may be generally downwardly sloped, such that a portion of each sidewall 136 abutting the front wall 132 is greater in height than a portion of each sidewall 136 abutting a rear edge 140 of the base floor 138. The base floor 138 may include a plurality of pegs 142. The pegs 142 are each configured to receive and hold a massage sleeve 38 to allow for storage of massage sleeves 38 when not in use. The base floor 138 may further include a plurality of openings through which a plurality of fasteners 144, such as screws or some other suitable type of fasteners, may be inserted in order to couple the rear support bracket 130 to the base 150 of the portable mounted rack apparatus 100. An opening may be provided on the front wall 132 of the rear support bracket 130 through which a fastener 134, such as a bolt, screw, or some other suitable type of fastener, may be inserted in order to couple the rear support bracket 130 to the support member 110. The rear support bracket 130 may be coupled to a rear-facing portion of the support member 110.

Referring to the base 150, the base 150 generally comprises a substantially square-shaped platform having a top surface 152 and side surfaces 154. While in this embodiment the base is substantially square-shaped, it would be possible for the base to be shaped in other ways, as desired, without departing from the spirit and scope of the invention. The top surface 152 may include one or more beveled edges 156, which may be positioned proximate an outer perimeter of the top surface 152. The top surface 152 may further include one or more beveled edges 158, which may be positioned proximate an outer perimeter of the base plate 124.

In order to utilize the massage attachment device 10 with the portable mounted rack apparatus 100, a user would first couple the massage attachment device 10 to the portable mounted rack apparatus 100 by inserting the pin 46 of the coupling member 44 through one of the openings 122 in the spine 116 of the support member 110. A user would select an opening 122 corresponding to an appropriate height desired by the user for utilizing the massage attachment device 10. A user would then reach through one of the side openings 128 adjacent to the selected opening 122 and engage the back plate 48 of the coupling member 44 onto the pin 46 to secure the massage attachment device 10 in place on the portable mounted rack apparatus 100. When the massage attachment device 10 is in position on the portable mounted rack apparatus 100, each of the stop arms 34 should abut a corresponding side surface 118 of the spine 116. In this way, the stop arms 34 will help to prevent the massage attachment device 10 from shifting from side to side when in position on the portable mounted rack apparatus 100. Once the massage attachment device 10 is in position on the portable mounted rack apparatus 100, a user may proceed to utilize the massage attachment device 10 to massage various muscles.

While embodiments of the disclosure have been described in terms of various specific embodiments, it will be recognized and understood by those skilled in the art that the embodiments of the disclosure may be practiced with modifications without departing from the spirit and scope of the invention.

What is claimed is:

1. A massage attachment device comprising, in combination:

a base member configured to be coupled to a rack apparatus, wherein the base member comprises:

an upper portion comprising:

a front vertical support having a "U" shaped frame:

a front support ring rotatably coupled to the "U" shaped frame of the front vertical support;

a back vertical support having a "U" shaped frame, a back support ring rotatably coupled to the "U" shaped frame of the back vertical support; and a lower portion having a pair of side plates wherein each of the pair of side plates angles downward, a back plate, a pair of spaced-apart stop arms attached to and extending away from the back plate, wherein each of the pair of stop arms has a notch and a pin member attached to and extending away from the back plate removably attaching the massage attachment device to an apparatus;

a roller bar coupled to the upper portion of the base member, wherein the roller bar rotatably extends through and is coupled to the back support ring and the front support ring, a front end of the roller bar extends outwardly from the front vertical support of the base member; and a massage sleeve configured to be slidably positioned on the roller bar.

2. The massage attachment device of claim 1, further comprising:

a massage ball coupled to the roller bar;

a locking tab formed on the front end of the roller bar; and an end cap engaging the locking tab securing the massage ball to the roller bar.

3. The massage attachment device of claim 1, wherein the base member comprises;

a front plate coupled to the "U" shaped frame of the front vertical support, the back plate coupled to the "U" shaped frame of the front vertical support, wherein the front support ring is coupled to the front plate;

a second front plate coupled to the "U" shaped frame of the back vertical support, the back plate of the lower portion coupled to the "U" shaped frame of the back vertical support, wherein the back support ring is interposed between the front plate coupled to the "U" shaped frame of the back vertical support and the back plate, wherein the back support ring is configured to receive a portion of the roller bar;

a first opening positioned on the front plate of the front vertical support;

a second opening positioned on the back plate of the front vertical support; and a third opening positioned on the front plate of the back vertical support; wherein the first opening, the second opening and the third opening are each configured to receive a portion of the roller bar.

4. The massage attachment device of claim 1, wherein the massage sleeve comprises a substantially elongated, tubular member having an outer surface, and wherein a plurality of massage nodules are positioned on the outer surface.

5. The massage attachment device of claim 1, wherein the base member is configured to be coupled to wall mounted rack apparatus.

* * * * *